US007065978B2

(12) United States Patent
Hong et al.

(10) Patent No.: US 7,065,978 B2
(45) Date of Patent: Jun. 27, 2006

(54) AIR CONDITIONER

(75) Inventors: Sang Min Hong, Daegu-si (KR); Jin Dong Kim, Seoul (KR); Chun Su Kang, Ulsan-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/761,413

(22) Filed: Jan. 22, 2004

(65) Prior Publication Data

US 2005/0034472 A1 Feb. 17, 2005

(30) Foreign Application Priority Data

Aug. 12, 2003 (KR) ..... 10-2003-0055752
Aug. 22, 2003 (KR) ..... 10-2003-0058266
Aug. 25, 2003 (KR) ..... 10-2003-0058751

(51) Int. Cl.
*F25D 23/12* (2006.01)

(52) U.S. Cl. ..... 62/259.1; 126/110 R; 236/91 D

(58) Field of Classification Search ..... 62/259.1, 62/414, 419, 426; 126/110 R; 165/65; 236/91 D
See application file for complete search history.

(56) References Cited

U.S. PATENT DOCUMENTS 2,365,797 A * 12/1944 Bichowsky ..... 62/333
2,893,220 A 7/1959 Blum
3,662,738 A * 5/1972 Solka et al. ..... 126/110 R
3,722,580 A * 3/1973 Braver ..... 165/50
4,169,500 A * 10/1979 Braver ..... 165/50
4,228,846 A * 10/1980 Smorol ..... 165/240
4,449,376 A * 5/1984 Draper et al. ..... 62/259.1
4,646,714 A * 3/1987 Bolin ..... 126/247
4,919,123 A 4/1990 Jackson et al.
5,332,028 A 7/1994 Marris
5,392,846 A * 2/1995 Gardner ..... 165/223
5,857,343 A * 1/1999 Cho et al. ..... 62/89
6,176,306 B1 * 1/2001 Gault ..... 165/240

FOREIGN PATENT DOCUMENTS

CN 2139238 Y 7/1993
WO WO 01/50067 A2 7/2001

* cited by examiner

*Primary Examiner*—William E. Tapolcai
(74) *Attorney, Agent, or Firm*—Birch Stewart Kolasch & Birch LLP

(57) ABSTRACT

An air conditioner is disclosed, which has an improved structure to use with easiness by connecting a duct thereto, the duct being in communication with the inside. The air conditioner includes a cabinet having an inlet for supplying air of an indoor room to the inside thereof, and an outlet for discharging the air conditioned therein to the indoor room; a barrier provided in the inside of the cabinet so as to guide the air supplied through the inlet to the outlet; a blower provided in the inside of the cabinet to draw the air of the indoor room through the inlet and to discharge the air to the outlet; and a heat exchanger provided in the inside of the cabinet to perform a heat-exchange process with the air flowing in the cabinet.

19 Claims, 17 Drawing Sheets

AIR CONDITIONER

This application claims the benefit of the Korean Application Nos. P2003-0055752 filed on Aug. 12, 2003, P2003-0058266 filed on Aug. 22, 2003 and P2003-0058751 filed on Aug. 25, 2003, which is hereby incorporated by reference.

BACKGROUND OF THE INVENTION

1. Field of the Invention

The present invention relates to an air conditioner, and more particularly, to an air conditioner having an improved structure to use with easiness by connecting a duct thereto, the duct being in communication with the inside, whereby the air conditioner is mounted on a convenient location according to the environmental circumstances.

2. Discussion of the Related Art

In general, an air conditioner maintains a room temperature at a most appropriate state proper to a purpose of a room by using a property of refrigerant in which the refrigerant discharges or absorbs heat to/from an environment when the refrigerant is involved in a phase change. For example, the air conditioner maintains the room in a cool state in summer, and a warm state in winter.

The air conditioner is provided with a compressor, a condenser, an expansion device, and an evaporator, and there are window type and separate type air conditioners. Herein, the window type air conditioner is provided with parts, such as first and second heat exchangers, and the compressor provided in a cabinet. Generally, the window type air conditioner is mounted to pass through a wall or window such that the first heat exchanger is in communication with the room, and the second heat exchanger and the compressor are in communication with the outdoor.

The separate type air conditioner is provided with an indoor unit and an outdoor unit connected with each other by a refrigerant pipe. The indoor unit has the first heat exchanger mounted therein, and the outdoor unit has the second heat exchanger and the compressor mounted therein.

the window type or separate type air conditioner, the second heat exchanger performs the heat-exchange with the outdoor air, and the first heat exchanger performs the heat-exchange with the room air. The room air heat-exchanged in the first heat exchanger is discharged to the room by a fan, to cool or heat the room.

However, when the indoor unit of the separate type air conditioner stands on the floor of the indoor room, the indoor unit occupies a large space in the room since the size of the indoor unit is large. Recently, the compact indoor unit mounted on the wall has been used. However, the indoor unit may stand on the floor of the indoor room, or may be mounted on the wall. Thus, the indoor unit has a limitation in that the indoor unit is mounted on the restricted circumstances.

SUMMARY OF THE INVENTION

Accordingly, the present invention is directed to an air conditioner that substantially obviates one or more problems due to limitations and disadvantages of the related art.

object of the present invention is to provide an air conditioner having an improved structure to use with easiness by connecting a duct thereto, the duct being in communication with the inside, whereby the air conditioner is mounted on a convenient location according to the environmental circumstances.

Another object of the present invention is to provide an air conditioner having an improved structure for easily changing a filter.

Another object of the present invention is to provide an air conditioner having an improved structure for easily repairing and changing components inside a cabinet.

Another object of the present invention is to provide an air conditioner having an improved structure for being connected with another device for heating the inside.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an air conditioner includes a cabinet having an inlet for supplying air of an indoor room to the inside thereof, and an outlet for discharging the air conditioned therein to the indoor room; a barrier provided in the inside of the cabinet so as to guide the air supplied through the inlet to the outlet; a blower provided in the inside of the cabinet to draw the air of the indoor room through the inlet and to discharge the air to the outlet; and a heat exchanger provided in the inside of the cabinet to perform a heat-exchange process with the air flowing in the cabinet.

At this time, the cabinet includes a plurality of frames being standing at corners of a base; an upper panel provided on upper parts of the frames, the upper panel having the inlet and the outlet; and a plurality of panels such as a front panel, a rear panel and side panels between the respective frames.

The front panel of the cabinet is provided with a plurality of pieces for being separately detachable.

The barrier is provided between the inlet and the outlet.

The cabinet includes a first extension projecting from the circumference of the inlet of the cabinet.

The cabinet includes a second extension projecting from the circumference of the outlet of the cabinet.

Furthermore, the air conditioner includes a first filter provided for covering the inlet.

The cabinet includes a first extension projecting from the circumference of the inlet, and having a slot supporting the circumference of the first filter which is inserted or separated through an open side.

Furthermore, the air conditioner includes a first duct having one end connected with the first extension, and the other end being in communication with at least one room or the outside.

The slot is provided along the inner circumferential surface of the first extension.

The slot is provided between the top of the cabinet and an upper part of the first extension.

Also, the air conditioner includes a second filter provided in the inside of the cabinet so as to filter foreign matters and smell particles of the air supplied to the inside of the cabinet through the inlet.

The air conditioner includes a supplementary heating device provided in the cabinet for heat-exchange with the air flowing in the cabinet.

The supplementary heating device is a first pipe through which hot water flows.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 5A to FIG. 5C illustrate the mounting state of the air conditioner shown in FIG. 1 or FIG. 3, wherein, FIG. 5A is a perspective view illustrating the air conditioner mounted on the floor, FIG. 5B is a cross-sectional view illustrating the air conditioner mounted on the wall, and FIG. 5C is a cross-sectional view illustrating the air conditioner mounted on the ceiling;

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Hereinafter, an air conditioner according to the present invention will be described with reference to the accompanying drawings.

Figure 1:
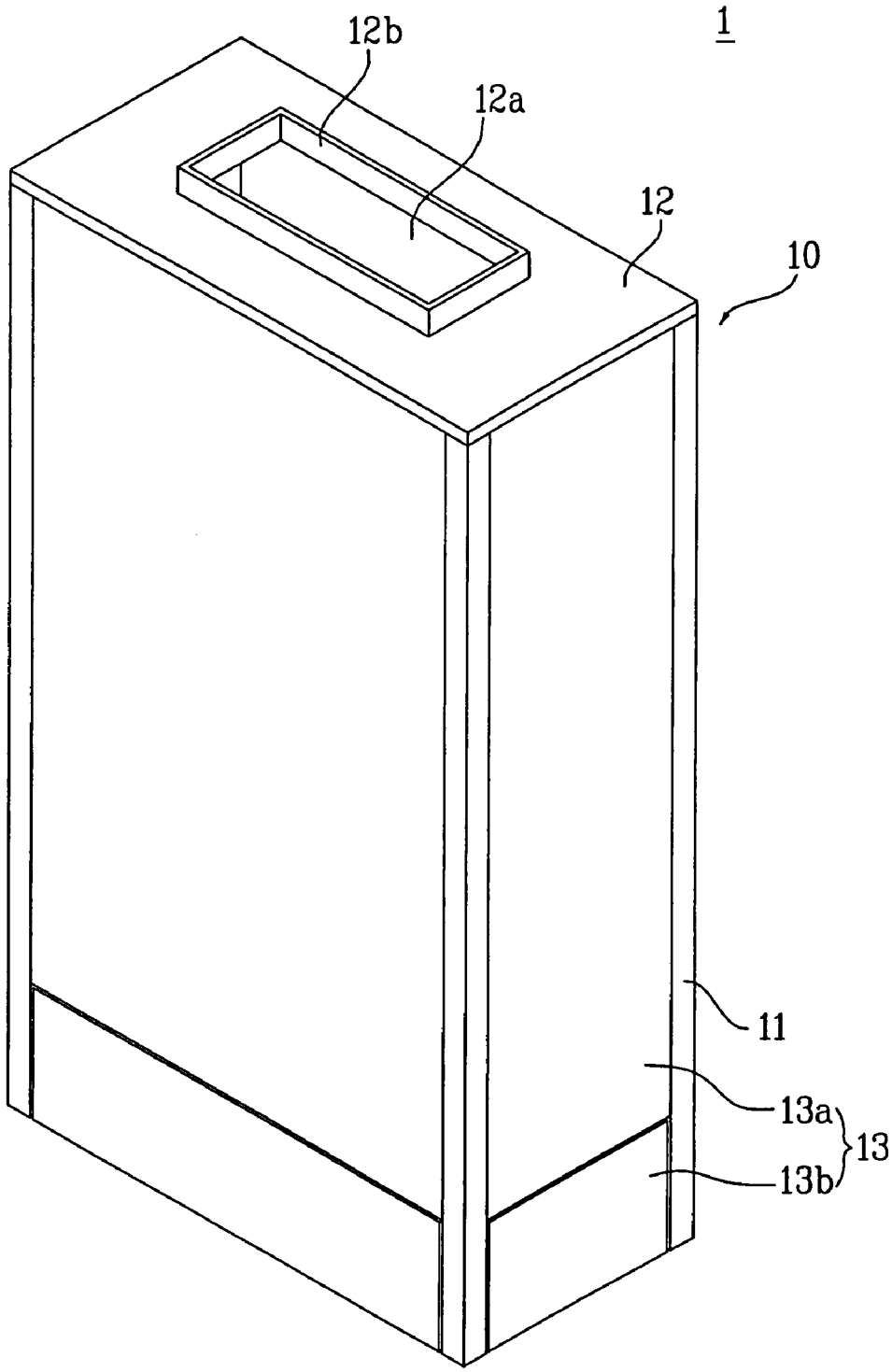
FIG. 1 is a perspective view illustrating an air conditioner according to the first embodiment of the present invention.
Figure 2:
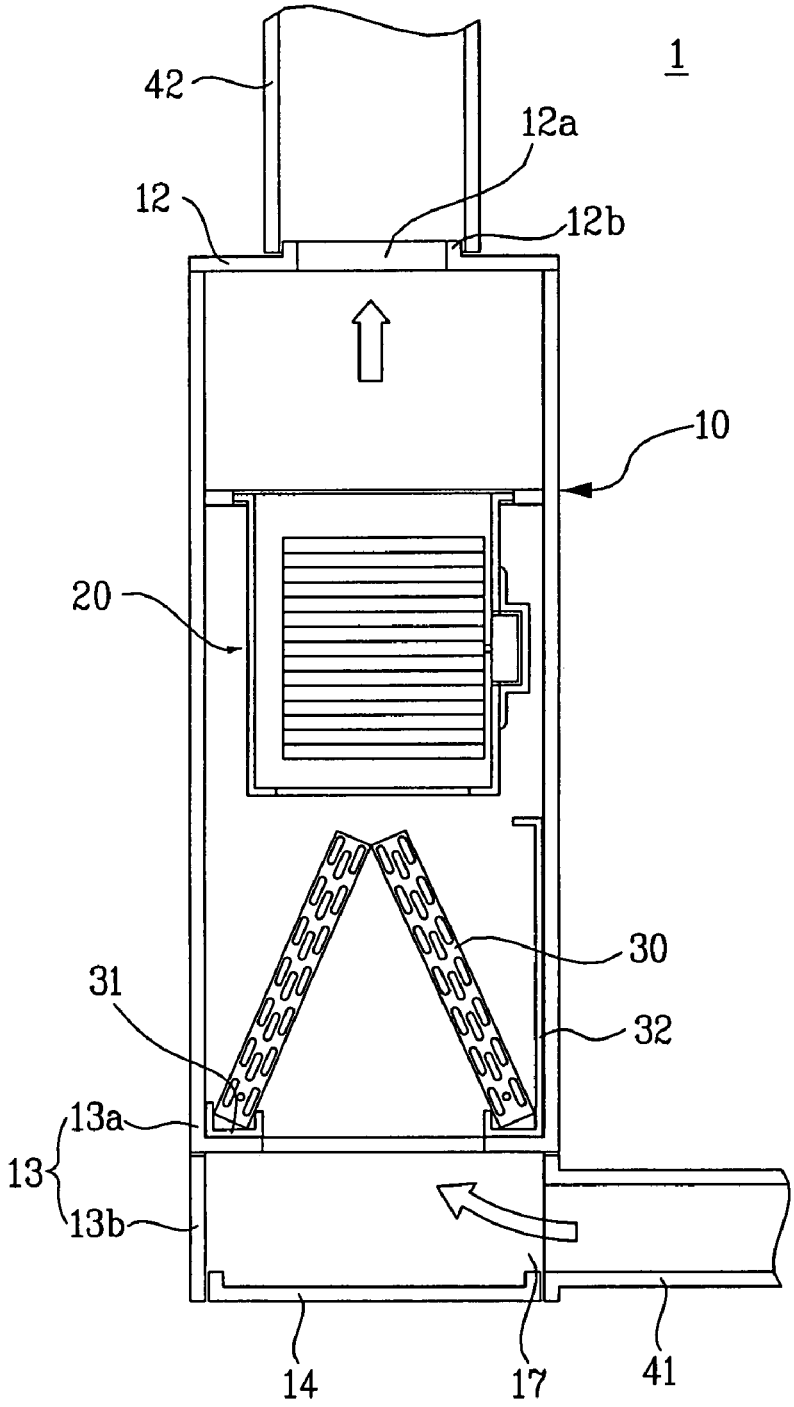
FIG. 2 is a cross-sectional view illustrating a duct connected to the air conditioner of FIG. 1.

FIG. 1 and FIG. 2 illustrate an air conditioner according to the first embodiment of the present invention. Referring to FIG. 1 and FIG. 2, the air conditioner has a first unit 1 including a cabinet 10, a blower 20, and a heat exchanger 30. The first unit 1 is connected with a second unit (not shown) provided in the outside by a refrigerant pipe (not shown). In this case, the first unit is provided in the inside of a building, or a room.

Hereinafter, the structure of first unit 1 will be described in more detail.

The cabinet 10 has a cavity and an outlet 12*a*. At this time, the cavity is provided inside the cabinet 10, and the outlet 12*a* is provided in an upper part of the cabinet 10. Also, the cabinet 10 includes a plurality of frames 11 and a plurality of panels provided between the respective frames 11.

Referring to FIG. 2, the frames 11 are provided in perpendicular at corners of a base 14 forming the bottom of the cabinet 10. Then, the upper panel 12 forming the top of the cabinet 10 is fixed on upper parts of the frames 11, and the side panel 13 is provided between the frames 11 so as to form the side of the cabinet 10.

The side panel 13 is divided into a first panel 13*a* provided in an upper side, and a second panel 13*b* provided in a lower side, in which the second panel 13*b* is smaller than the first panel 13*a*. At this time, the second panel 13*b* may be separated from the cabinet 10, and an opening formed by removing the second panel 13*b* may form an inlet 17.

Accordingly, it is possible to provide the cabinet 10 according to location requirements for the first unit 1 after making the inlet 17 by removing any one of the second panels 13*b*. Or, it is possible to provide the cabinet 10 by removing the base 14 instead of the second panel 13*b*. In this respect, the base 14 also has the structure easily separated from the cabinet 10. Meanwhile, as shown in FIG. 2, the inlet 17 may be connected with a first duct 41. The first duct 41 is in communication with at least one room to cool or heat, or the outside.

Furthermore, an extension 12*b* may be provided in the circumference of the outlet 12*a* provided in the upper panel 12. In this case, the user connects a second duct 42 being in communication with the room to the extension 12*b*. Thus, air discharged from the inside of the cabinet 10 is provided to the indoor room through the second duct 42, whereby it has advantageous characteristics in that the user selectively mounts the first unit 1 at the convenient location. Meanwhile, the second duct 42 may be in communication with one room, or several rooms. In this case, it is possible to cool or heat the several rooms with one first unit 10, for example, an indoor unit.

The blower 20 is provided in the cabinet 10 between the inlet 17 and the outlet 12*a*. The blower 20 draws the air through the inlet 17, and discharges the air to the outlet 12*a*. Also, the heat exchanger 30 is provided in the cabinet 10, for example, between the blower 20 and the inlet 17. However, it is possible to provide the heat exchanger 30 between the outlet 12*a* and the blower 20. The heat exchanger 30 performs the heat-exchange with the air drawn into the inside of the cabinet 10 through the inlet 17.

Then, a first tray 31 is provided below the heat exchanger 30 so as to receive water condensed on a surface of the heat exchanger 30. In this case, the first tray 31 is connected with a drain hose (not shown) connected with the outside, whereby the water stored in the first tray 31 is discharged to the outside of the cabinet 10.

Figure 5A:
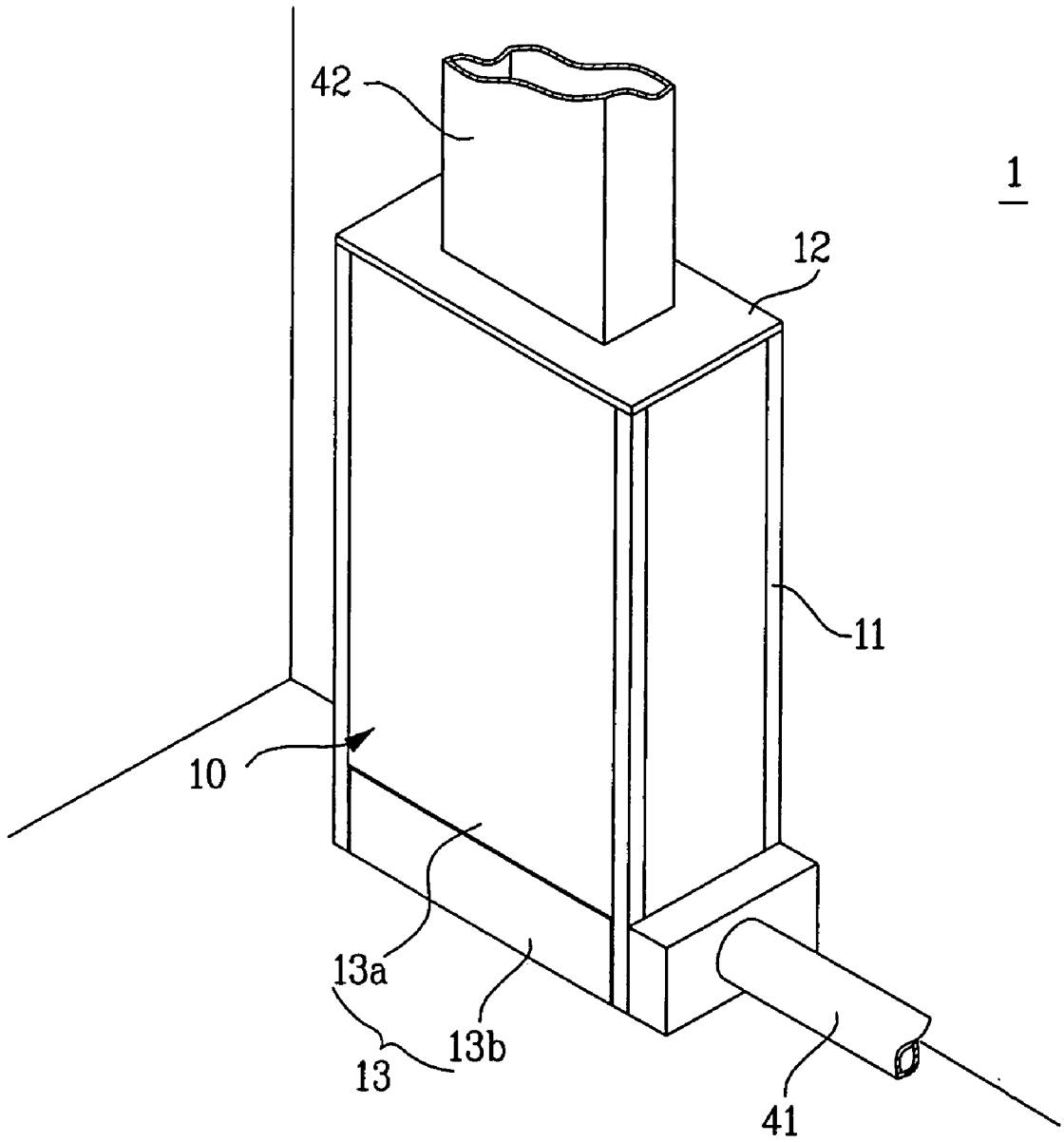
Figure 5B:
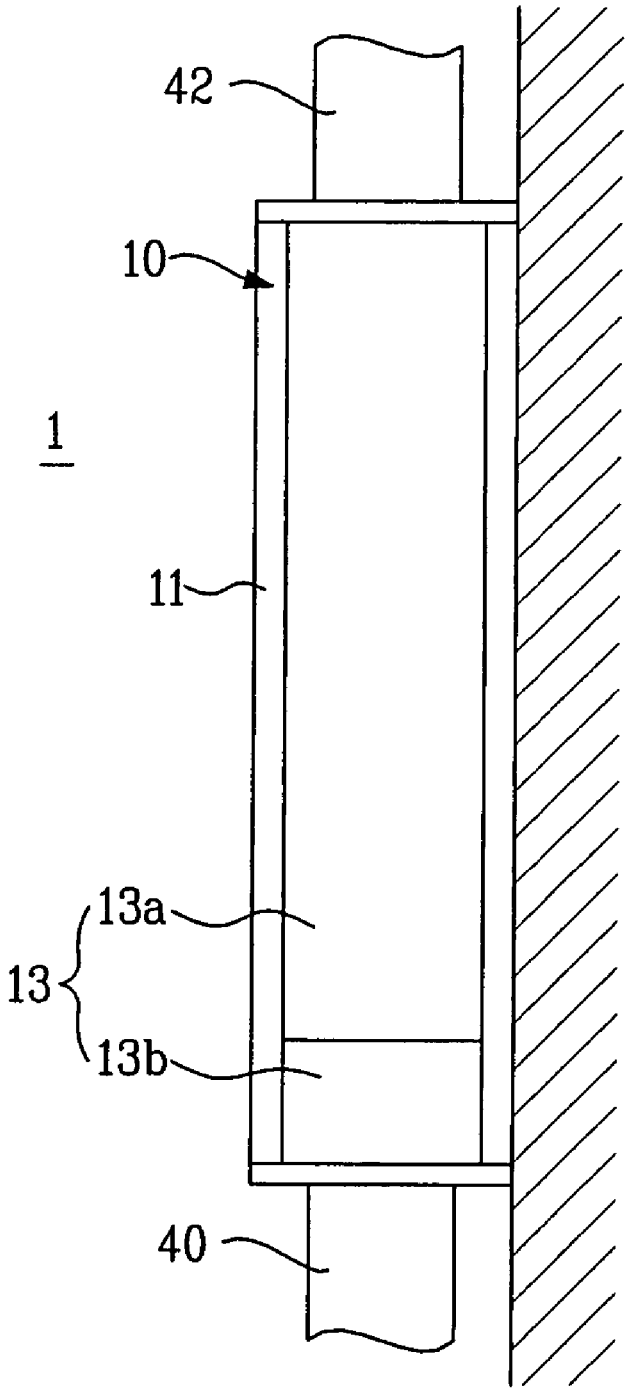
Figure 5C:
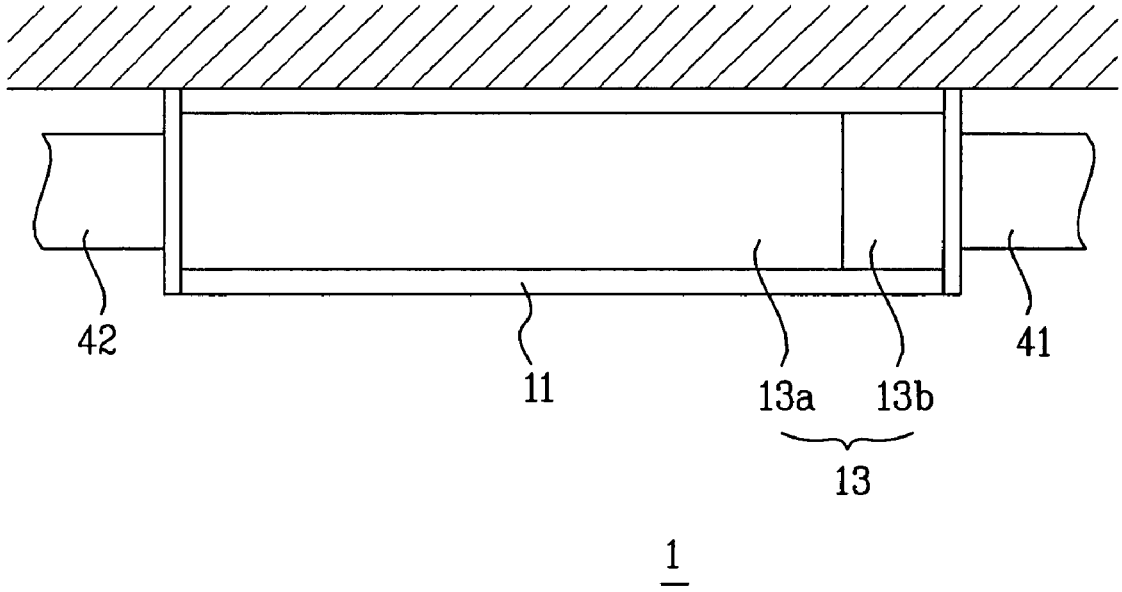

In the air conditioner according to the present invention, the cabinet 10 may stand on the room as shown in FIG. 2, or the cabinet 10 may be laid down on the room as shown in FIG. 5C. Accordingly, in case the cabinet 10 is laid down, it is preferable to form a second tray 32 receiving the water condensed on the heat exchanger 30. Also, the second tray 32 is connected with the drain hose.

Figure 3:
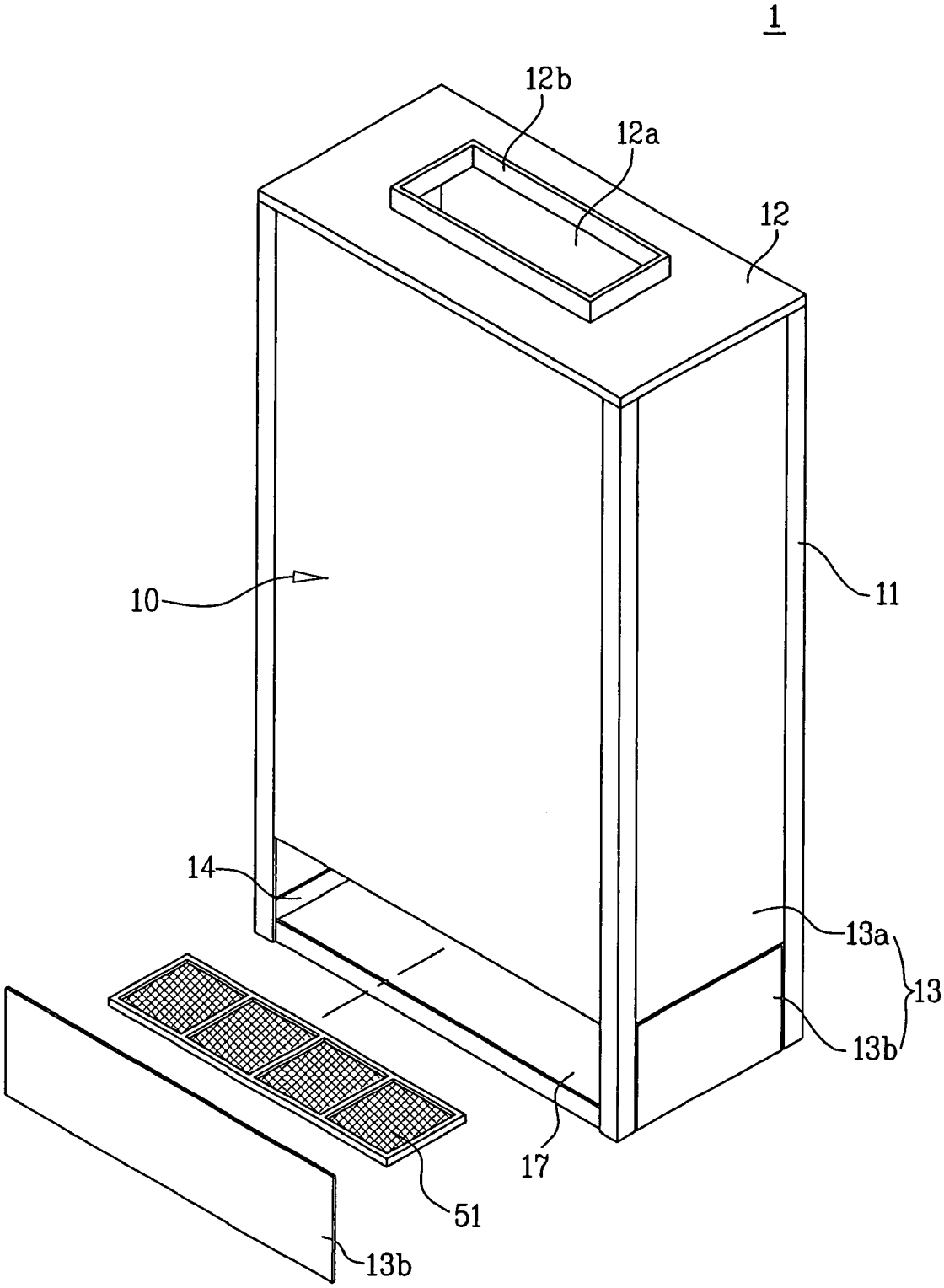
FIG. 3 is a partially separated perspective view illustrating an example of providing a filter to the air conditioner of FIG. 1.
Figure 4:
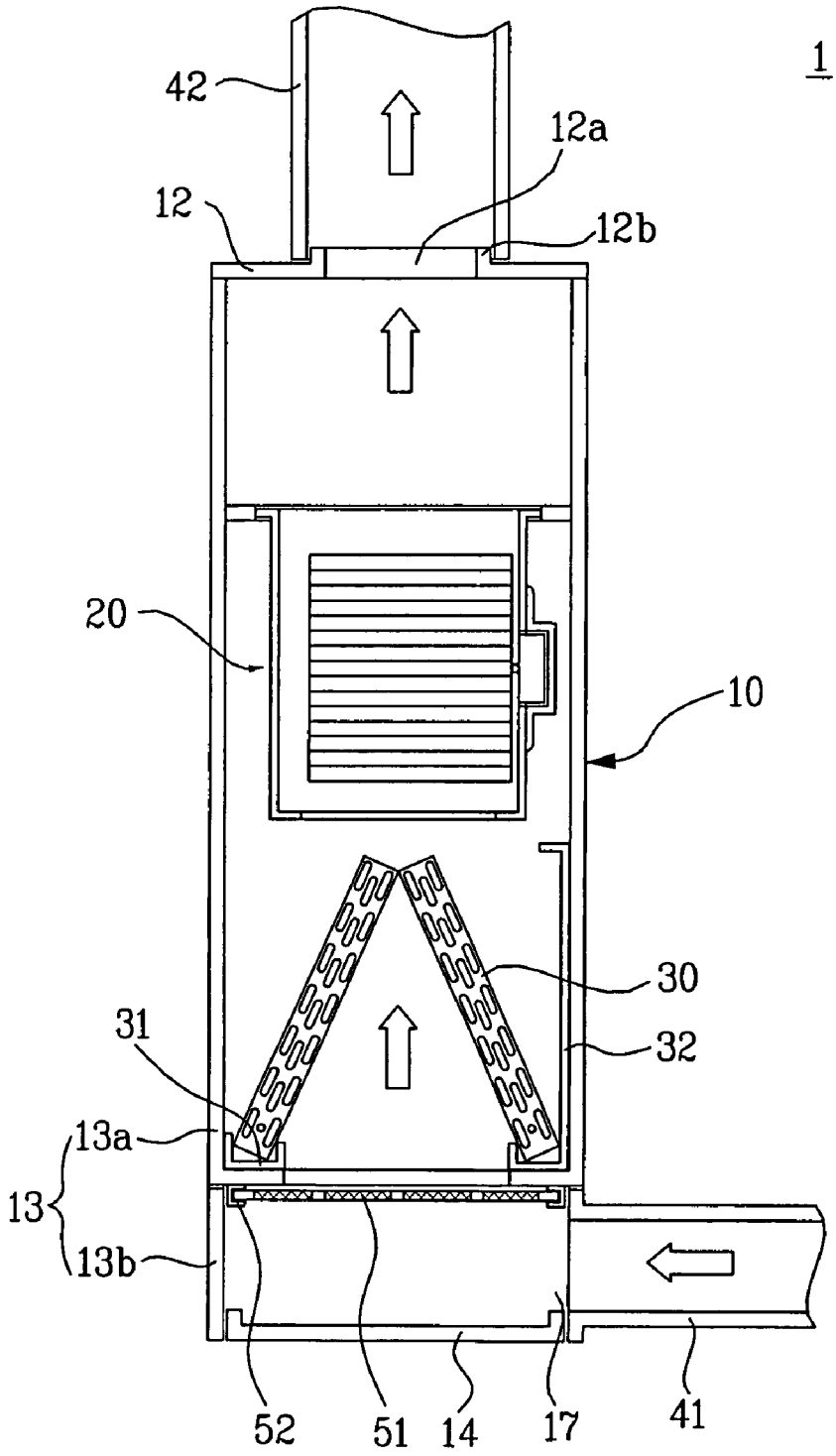
FIG. 4 is a cross-sectional view illustrating a duct connected to the air conditioner of FIG. 3.

Meanwhile, in the air conditioner according to the present invention, as shown in FIG. 3 and FIG. 4, a filter 51 is additionally provided. The filter 51 is provided adjacent to the inlet 17, whereby the filter 51 filters foreign particles from the air drawn through the inlet 17. In order to fix the filter 51, a bracket 52 is provided in the inside of the cabinet 10 so as to hold the edge of the filter 51. The filter 51 may be provided or changed after separating one of the second panels 13*b*.

In the air conditioner having the aforementioned structure, the first unit 1 may stand on the floor as shown in FIG. 5A, the first unit 1 may be mounted on the wall as shown in FIG. 5B, or the first unit 1 may be mounted on the ceiling as shown in FIG. 5C. In this state, the user makes the inlet 17 after removing any one of the second panels 13*b* or the base 14 according to the circumstances for locating the air conditioner, and then connects the first duct 41 to the inlet 17. Also, the second duct 42 is connected with the outlet 12*a*.

On operating the air conditioner, when the blower 20 is rotated, the indoor air is drawn into the inside of the cabinet 10 through the first duct 41. In this case, if the first duct 41 is in communication with the outside, the outdoor air is drawn into the inside of the cabinet 10. The air drawn into the inside of the cabinet 10 is cooled or heated by the heat-exchange with the heat exchanger 30, and then the heat-exchanged air is transmitted to the second duct 42 by the blower 20. The air transmitted to the second duct 42 is provided into the room so as to cool or heat the air inside the room. At this time, in case the second duct 42 is in communication with the several rooms, the air transmitted to the second duct 42 cools or heats the air of the several rooms.

In the air conditioner according to the first embodiment of the present invention, it is possible to provide the first unit 1 at different locations, thereby improving efficiency in using the space inside the room. Also, since the duct is connected with the several rooms, it is possible to cool or heat the several rooms with one first unit 1. However, in the air conditioner according to the first embodiment of the present invention, the first and second ducts 41 and 42 are respectively connected with both ends of the cabinet 10 in a longitudinal direction of the cabinet 10. Accordingly, it is hard for the user to mount the air conditioner in case the space for locating the air conditioner is small. Also, when the user mounts the air conditioner, it is required to connect the first duct 41 after separating the second panel 13*b* or the base 14, thereby generating a user's inconvenience.

In order to overcome the problem of the air conditioner according to the first embodiment of the present invention, air conditioners according to the second to fourth embodiments of the present invention will be described as follows. The air conditioners according to the second to fourth embodiments of the present invention have all advantageous characteristics of the air conditioner according to the first embodiment of the present invention. In addition, the air conditioners according to the second to fourth embodiments of the present invention are advantageous in that the user can mount the air conditioners with easiness. Hereinafter, the air conditioners according to the second to fourth embodiments of the present invention will be described with reference to the accompanying drawings.

Figure 6:
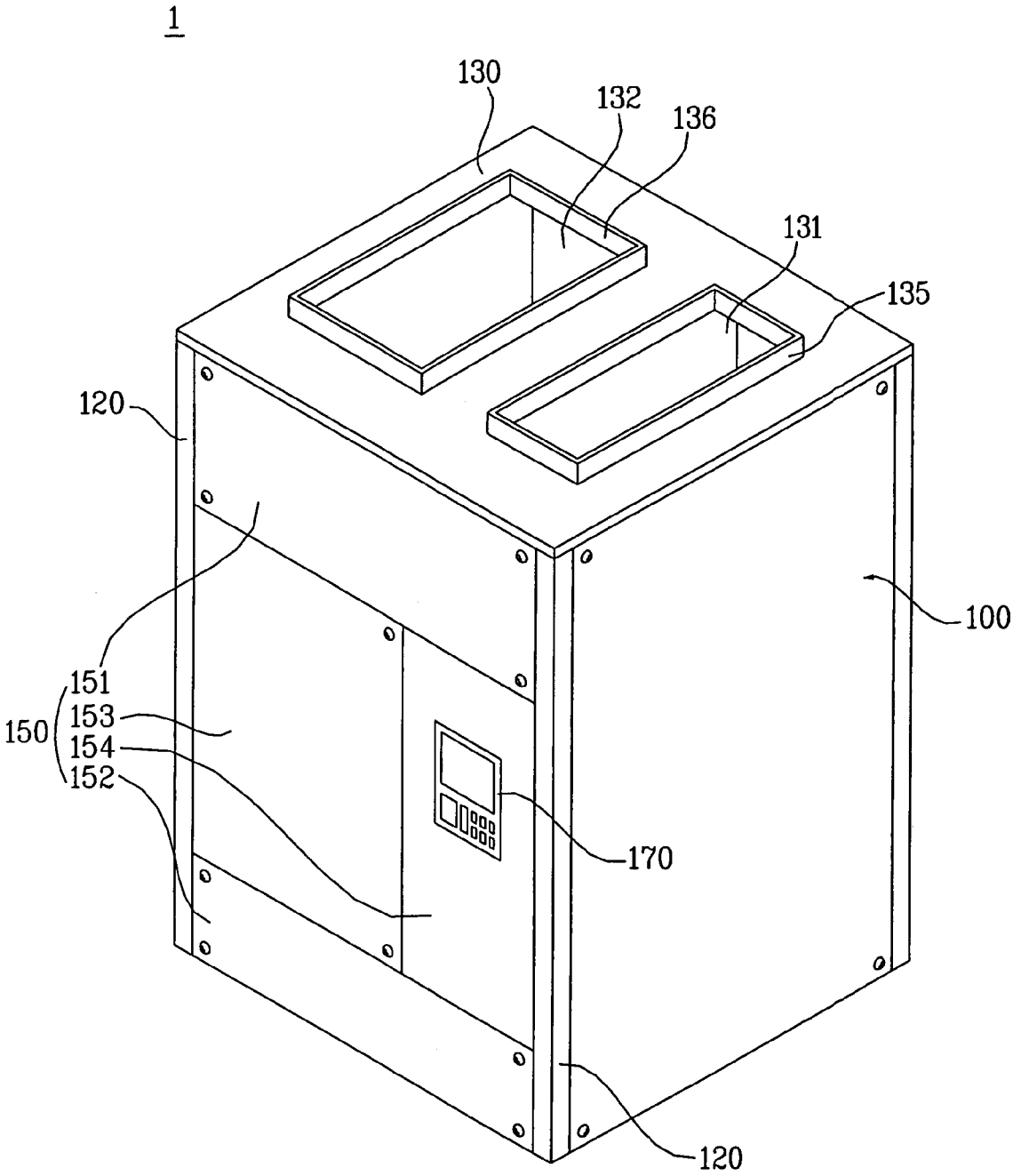
FIG. 6 is a perspective view illustrating an air conditioner according to the second embodiment of the present invention.
Figure 7:
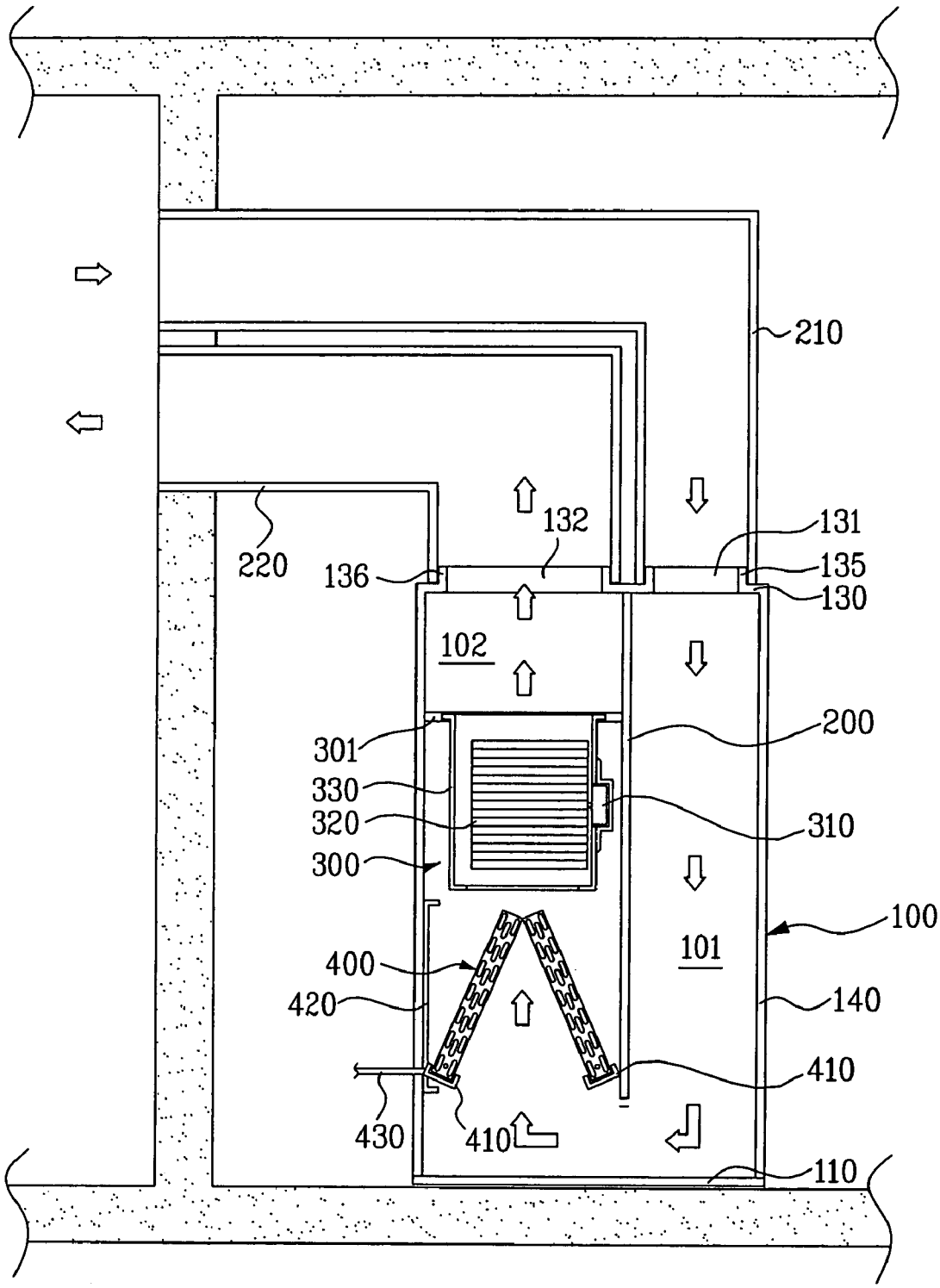
FIG. 7 is a cross-sectional view illustrating the mounting state of the air conditioner of FIG. 6.
Figure 14:
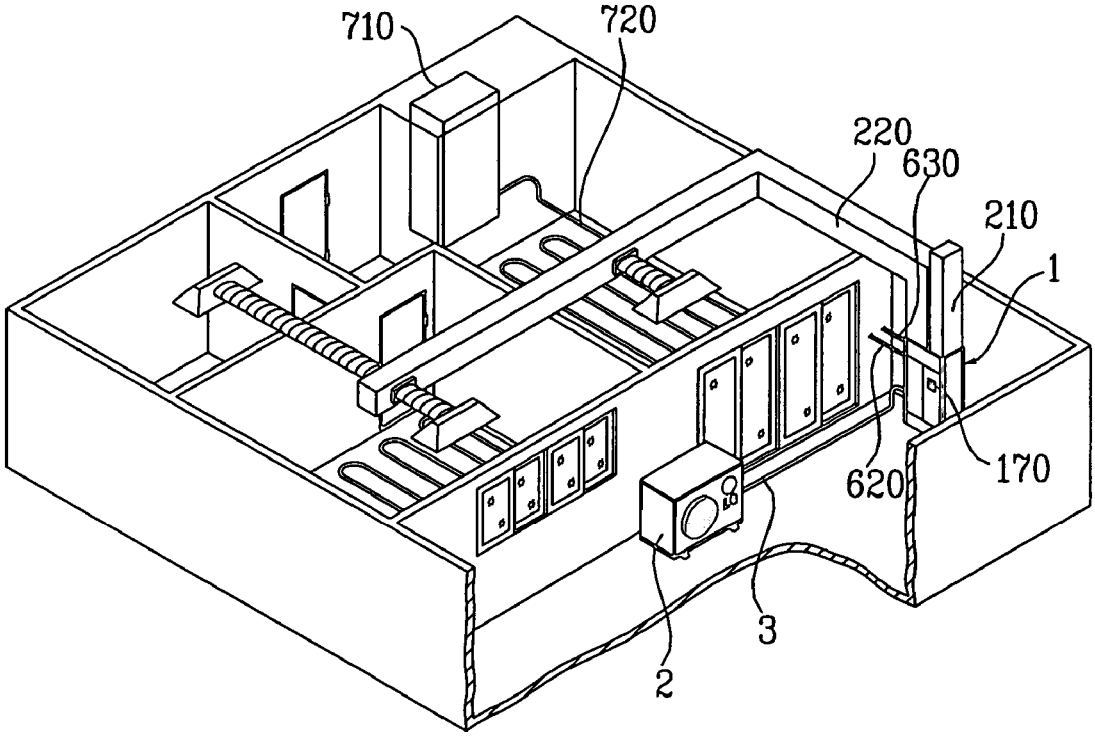
FIG. 14 is a perspective view illustrating an air conditioner of FIG. 11 mounted in the building.

FIG. 6 and FIG. 7 illustrate the air conditioner according to the second embodiment of the present invention. Referring to FIG. 6 and FIG. 7, the air conditioner according to the second embodiment of the present invention includes a first unit 1 and a second unit 2 (FIG. 14) connected with each other by a refrigerant pipe 3 (FIG. 14). At this time, the first unit 1 may be selectively provided in the indoor room to cool or heat, or the other space. Also, the second unit 2 may be provided in a space separated from the indoor room to cool or heat, for example, the outside. Meanwhile, the second unit 2 includes a compressor (not shown) being in communication with the first unit 1 by the refrigerant pipe 3, and a second heat exchanger (not shown).

Meanwhile, the first unit 1 includes a cabinet 100, a barrier 200 provided inside the cabinet 100, a blower 300, and a first heat exchanger 400 connected with the second heat exchanger of the second unit 2.

The cabinet 100 is provided with a plurality of frames 120 and a plurality of panels. Also, an inlet 131 and an outlet 132 are provided in the top of the cabinet 100. Hereinafter, the structure of the cabinet 100 will be described with reference to FIG. 6 and FIG. 7.

The frames 120 are provided in perpendicular at corners of a base 110 forming the bottom of the cabinet 100, and the upper panel 130 forming the top of the cabinet 100 is fixed on upper parts of the frames 120. Then, the inlet 131 and the outlet 132 are provided in the upper panel 130 at a fixed interval.

The panels are formed of a front panel 150, a rear panel (not shown) and a side panel 140 provided between the respective frames 120 so as to form the front, rear and side portions of the cabinet 100. At this time, a control panel 170 is provided in the front panel 150, through which a user can control the air conditioner according to the second embodiment of the present invention. Meanwhile, the cabinet 100 is not limited to the aforementioned structure. For example, it is possible to design the structure of forming the side panel 140 and the rear panel in one body.

Meanwhile, in the air conditioner according to the present invention, the front panel 150 is provided with a plurality of divided pieces, and each piece is separately detachable. For example, as shown in FIG. 6, the front panel 150 is provided with a first panel 151 provided in an upper side, a second panel 152 provided in a lower side, and third and fourth panels provided at left and right sides of the space between the first and second panels 151 and 152. This structure is useful to repair and change components provided inside the cabinet 100.

The barrier 200 is provided in the inside of the cabinet 100 between the inlet 131 and the outlet 132 so as to guide the air drawn into the inside of the cabinet 100 through the inlet 131 to the outlet 132. At this time, one end of the barrier 200 is connected with the upper panel 130 provided between the inlet 131 and the outlet 132, and the other end is provided at an opposite surface thereto. That is, the other end of the barrier 200 is provided at a fixed interval from the base 110.

The barrier 200 divides the inside space of the cabinet 100 into a first flow passage 101 for the air supplied from the indoor room to the inside of the cabinet 100 through the inlet 131, and a second flow passage 102 for the air discharged through the outlet 132. The first flow passage 101 is in communication with the second flow passage 102 at an inner lower part of the cabinet 100. Accordingly, the air supplied through the inlet 131 flows along a U-shaped passage inside the cabinet 100, and then the air is discharged through the outlet 132.

For example, the blower 300 is provided inside the cabinet 100 on the second flow passage 102. The blower 300 includes a fan 320, a motor 310 rotating the fan 320, and a housing 330 surrounding the fan 320. At this time, the housing 330 is supported with a bracket 301 fixed to the cabinet 100 and the barrier 200. Accordingly, when the fan 320 is rotated with operation of the motor 310, the air supplied through the inlet 131 passes through the first flow passage 101 and the second flow passage 102, and then the air is discharged through the outlet 132.

For example, the first heat exchanger 400 is provided inside the cabinet 100 on the second flow passage 102. Accordingly, the air passing through the second flow passage 102 is heat-exchanged in the first heat exchanger 400, and then the air is discharged through the outlet 132. In the air conditioner according to the present invention, as shown in FIG. 7, the first heat exchanger 400 has a curved shape so as to increase a heat exchange area with the air. For instance, the first heat exchanger 400 is provided below the blower 300.

A first tray 410 is provided at a lower part of the first heat exchanger 400 to receive the water condensed on the surface of the first heat exchanger 400. Also, a second tray 420 is provided at any one of the sides of the first heat exchanger 400 so as to receive the water condensed in case the cabinet 100 is laid down in case the cabinet 100 is laid down. In FIG. 7, the second tray 420 is provided in the barrier 200. However, it is possible to provide the second tray 420 in the cabinet 100. In this case, a drain hose 430 being in communication with the outside is connected with the first and second trays 410 and 420.

Meanwhile, referring to FIG. 7, the first duct 210 is connected with the inlet 131, and the second duct 220 is connected with the outlet 132. The first duct 210 may be in communication with the indoor room to cool or heat, or the outdoor room. If the first duct 210 is in communication with the indoor room, the first unit 1 draws the air from the indoor room, and discharges the air heat-exchanged in the first heat exchanger to the indoor room, thereby supplying the air of optimum temperature to the indoor room.

The second duct 220 may be in communication with one room, or several rooms. In case the second duct 220 is in communication with one room, the first unit 1 cools or heats one room. However, in case the second duct 220 is in communication with the several rooms, the first unit 1 cools or heats the several rooms simultaneously. In this case, it is required that the first and second units have large capacity.

Meanwhile, first and second extensions 135 and 136 are additionally provided in the circumferences of the inlet 131 and the outlet 132, whereby the first and second ducts 210 and 220 are respectively connected with the inlet 131 and the outlet 132. For example, the first extension 135 is projected upward in the circumference of the inlet 131, and the inner circumferential surface of the first duct 210 is inserted into the outer circumferential surface of the first extension 135. Also, the second extension 136 is projected upward in the circumference of the outlet 132, and the inner circumferential surface of the second duct 220 is inserted into the outer circumferential surface of the second extension 136.

The aforementioned air conditioner according to the second embodiment of the present invention is operated as follows.

When it is required to cool the indoor room, the compressor of the second unit is operated to provide a low temperature refrigerant. to the first heat exchanger 400. When the blower 300 is operated, the air supplied to the inside of the cabinet 100 through the first duct 210 passes through the first flow passage 101 and the first heat exchanger 400. At this time, the refrigerant flowing in the first heat exchanger 400 absorbs the heat of the air, whereby the air passing through the first heat exchanger 400 becomes cool. The cooled air is transmitted to the second duct 220 by the blower 300, and then discharged to the indoor room, thereby cooling the indoor room.

Meanwhile, when it is required to heat the indoor room, the compressor of the second unit is operated to provide a high temperature refrigerant to the first heat exchanger 400. Then, the air drawn into the inside of the cabinet 100 by the blower 300 is heated in the first heat exchanger 400, thereby heating the indoor room.

Furthermore, the air conditioner according to the present invention requires a bypass, a valve and a controller so as to change the flow passage direction of the refrigerant according to an operation mode, thereby selectively cooling or heating the indoor room. However, this technique is generally used in the recent art, the detailed explanation will be omitted.

Meanwhile, the air conditioner according to the second embodiment of the present invention, the first and second ducts 210 and 220 are connected with the cabinet 100, whereby the cabinet 100 is selectively provided in the inside, the inside of building, or the outside. In case the cabinet 100 is provided inside, it is possible not to provide the first and second ducts 210 and 220. However, if the cabinet 100 is provided in the inside of building or the outside, the first and second ducts 210 and 220 are respectively connected with the inlet 131 and the outlet 132 provided in the cabinet 100.

At this time, the inlet 131 and the outlet 132 are provided in the top of the cabinet 100. That is, even though the cabinet 100 is mounted for being standing or being laid, the user can mount the cabinet 100 with easiness. Also, it is not required to remove the panel or the base so as to make the inlet. In addition, the inlet and the outlet are provided for being adjacent to each other, the user can easily provide the cabinet in a small space.

Meanwhile, in the air conditioner according to the present invention, it is preferable to provide a filter for removing foreign matters from the air drawn into the inside of the cabinet through the inlet 131. Accordingly, the air conditioner according to the present invention further includes the filters, thereby improving the cleaned air to the indoor room.

FIG. 8 to FIG. 10D illustrate an air conditioner according to the third embodiment of the present invention. Hereinafter, the air conditioner according to the third embodiment of the present invention will be described with reference to the accompanying drawings. For reference, the air conditioner according to the third embodiment of the present invention generally has the similar structure to that of the air conditioner according to the second embodiment of the present invention, whereby the explanation for the general structure of the air conditioner according to the third embodiment of the present invention will be omitted. Herein, the filter and the structure thereof in the air conditioner according to the third embodiment of the present invention will be described in more detail.

Figure 8:
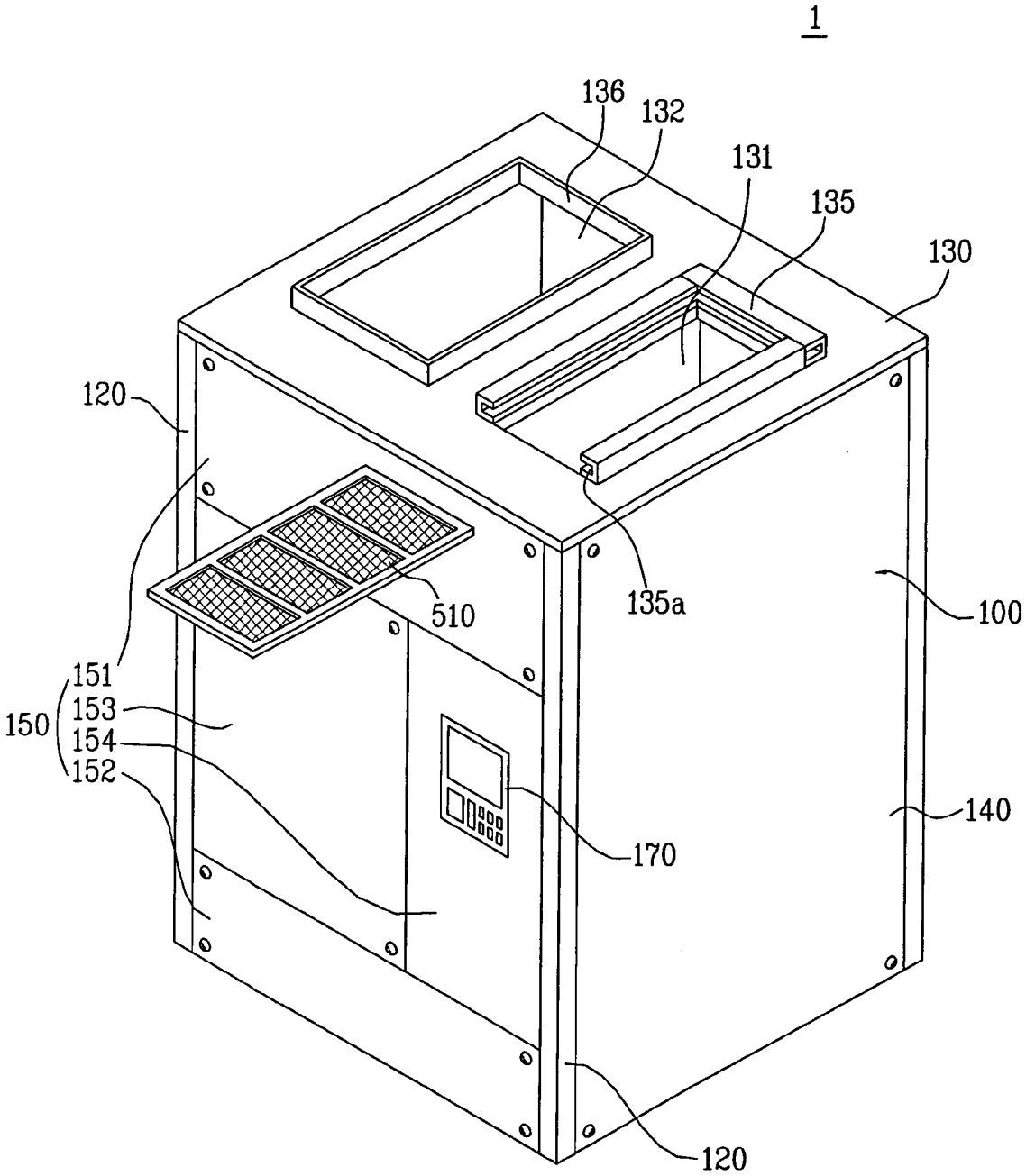
FIG. 8 is a perspective view illustrating an air conditioner according to the third embodiment of the present invention.
Figure 9:
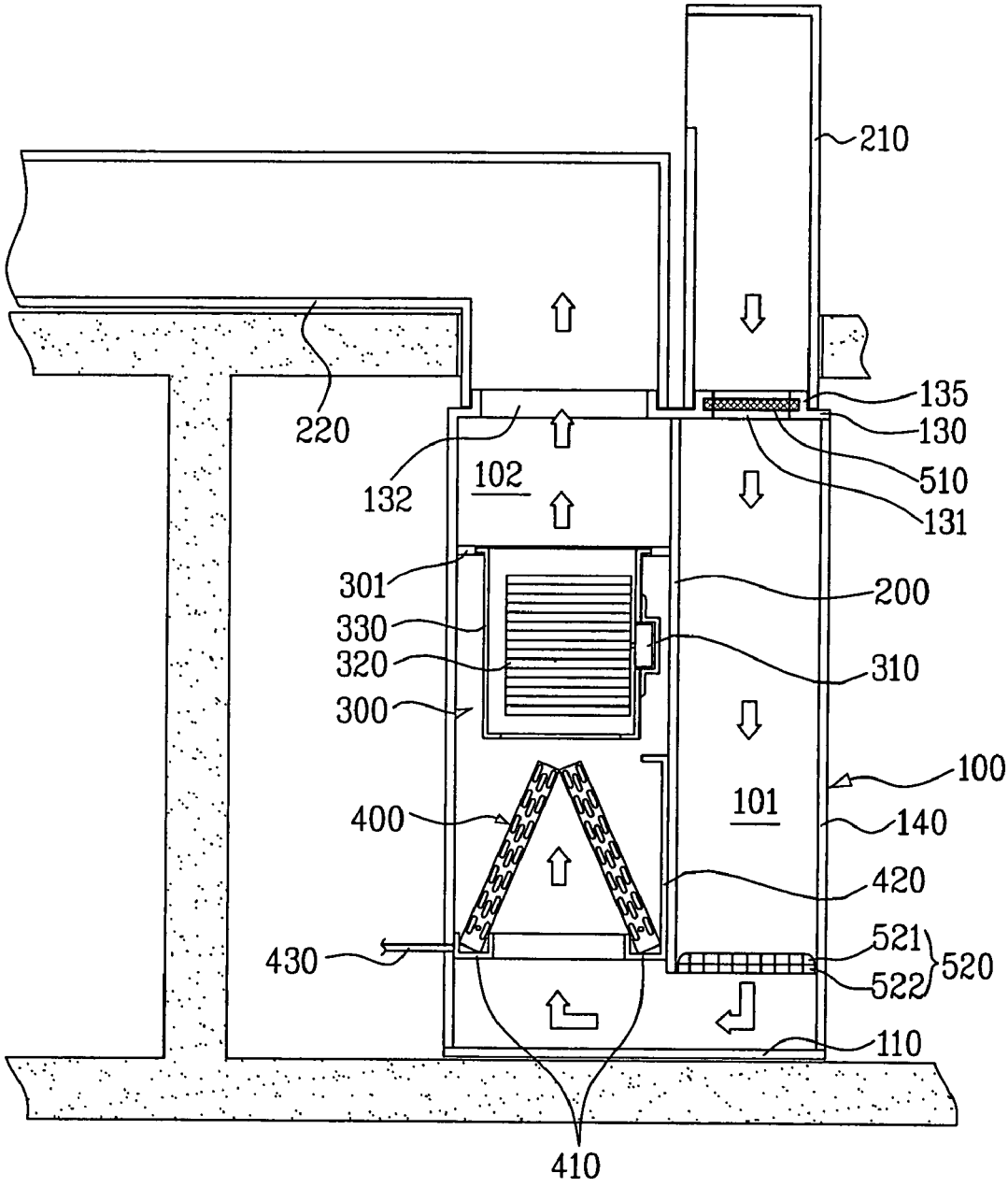
FIG. 9 is a cross-sectional view illustrating the mounting state of the air conditioner of FIG. 8.

Referring to FIG. 8 and FIG. 9, the air conditioner according to the third embodiment of the present invention includes a first filter 510 for covering an inlet 131. The first filter 510 is provided for filtering dust of the air drawn into the inside of the cabinet through the inlet 131. For example, the first filter 510 is provided in a mesh-shaped form. The first filter 510 has an improved shape suitable for cleaning and changing easily. Thus, the air conditioner according to the third embodiment of the present invention supplies the first filter 510 having the improved structure for the easy mounting and separating processes. Hereinafter, the structure of the first filter 510 will be described as follows.

The first filter 510 is mounted in a first extension 135. For this, one side of the first extension 135 is open, and a slot 135*a* is provided along the inner circumferential surface of the first extension 135. Accordingly, the first filter 510 is inserted through the open side of the first extension 135, and the circumference of the first filter 510 is inserted into the slot 135*a* by sliding along the slot 135*a*.

At this time, the first extension 135 may be projected upward at both sides of the inlet 131, whereby the slot 135*a* supports both circumferential sides of the first filter 510. However, in this case, it has a problem of inserting the first filter 510 to a great degree, whereby it is hard to determine a final fixation location of the first filter 510. Thus, as shown in FIG. 8, it is preferable to provide the first extension 135 of the structure having one open side and the other side being closed. Accordingly, when the user inserts the first filter 510, it is possible to prevent the first filter from being inserted to the great degree, whereby the final fixation location of the first filter 510 is determined easily.

Meanwhile, the slot 135*a* may be provided along the inner circumferential surface of the first extension 135. In this case, as shown in FIG. 10A and FIG. 10C, the first extension 135 has a U-shaped section having the open side provided in the inner side of the first extension 135.

However, the slot 135*a* may be provided on the top of the cabinet 100, between the top of the upper panel 130 and the upper part of the first extension 135. In this case, as shown in FIG. 10B and FIG. 10D, the first extension 35 is formed in an angle-shaped section.

Figure 10A:
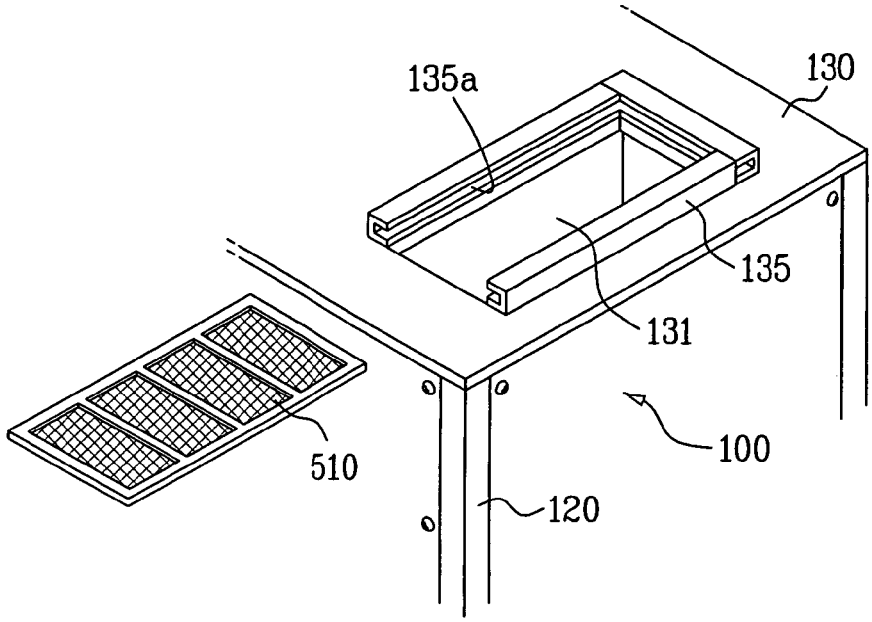
FIG. 10A and FIG. 10B are perspective views illustrating the various preferred embodiments for mounting a first filter on the air conditioner of FIG. 8.
Figure 10B:
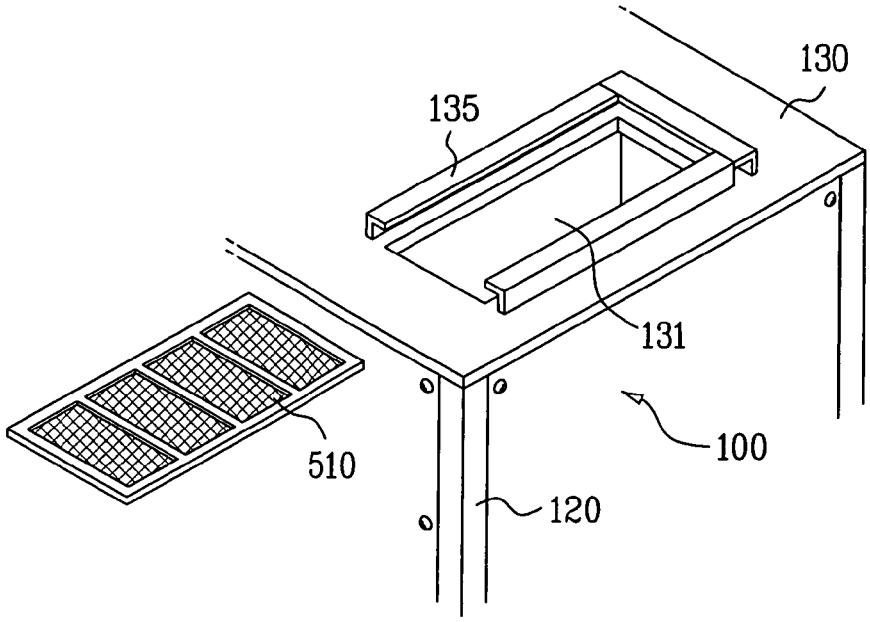
Figure 10C:
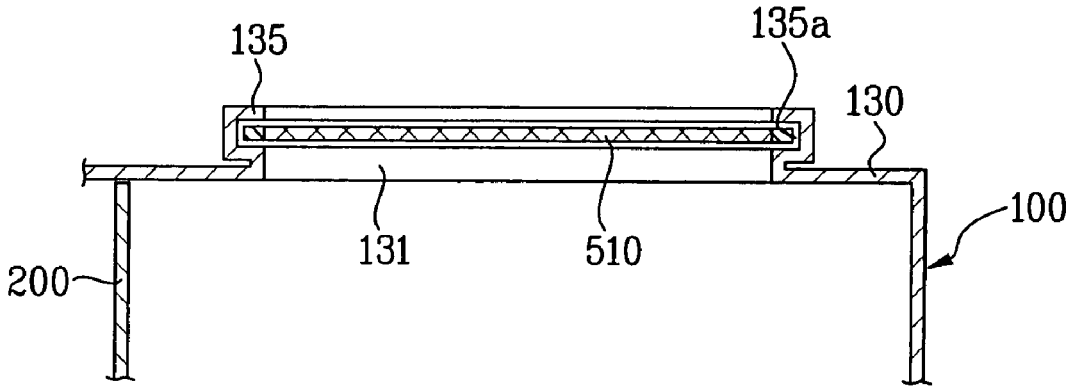
FIG. 10C and FIG. 10D are cross-sectional views illustrating the various preferred embodiments for mounting a first filter on the air conditioner of FIG. 8.
Figure 10D:
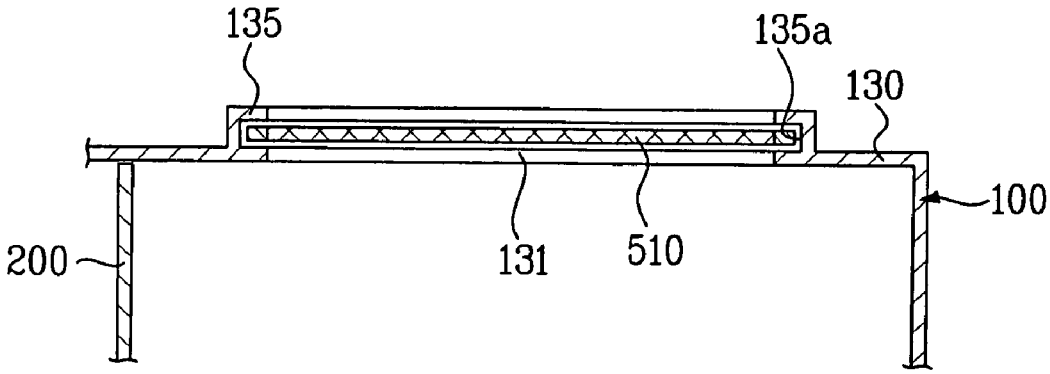

As shown in FIG. 10A and FIG. 10B, the first extension 135 having one open side and the slot 135*a* may be provided for being separated from the upper panel 130. In this case, the first extension 135 is fixed to the upper panel 130 by using an adhesive or a coupling member, or by welding. However, as shown in FIG. 10C and FIG. 10D, the first extension 135 may be provided in one body with the upper panel 130. In this case, the upper panel 130 and the first extension 135 may be provided in one body. At this time, the upper panel 130 and the first extension 135 are formed of synthetic resins.

Meanwhile, since the first filter 510 is provided in the mesh-shaped form, it is possible to filter the large-sized foreign matters from the air. However, it is impossible to filter minute foreign matters and smell particles of the air with the first filter 510. Accordingly, it is required to provide a second filter 520 for filtering the minute foreign matters and smell particles of the air.

Referring to FIG. 9, the second filter 520 is provided in the inside of the cabinet 100, and more particularly, on a first flow passage 101. At this time, the second filter 520 is provided in parallel to a base 110 at an end portion of a barrier 200. However, it is possible to provide the second filter 520 between the end portion of the barrier 200 and the base 110.

For example, the second filter 520 may be formed of a plasma filter operated automatically. The second filter 520 includes an ionization part 521 for ionizing the dust of the air, a collection part 522 provided at the rear of the ionization part 521 to collect the ionized dust, and a high voltage generating part (not shown) for applying a high voltage to the ionization part 521 and the collection part 522. Hereinafter, the structure of the second filter 520 will be described in more detail.

The ionization part 521 is provided with grounding electrodes at fixed intervals, and discharge electrodes in-between. At this time, the discharge electrodes are provided in perpendicular to the flow passage direction of the air, and the discharge electrodes form (+) pole by receiving the high voltage from the high voltage generating part.

The collection part 522 includes a collector and an acceleration electrode. At this time, the collector adsorbs the foreign matters ionized in the ionization part 521, and the acceleration electrode accelerates the foreign matters ionized in the ionization part to a collection electrode.

In case the first and second filters 510 and 520 are provided in the inside of the cabinet 100, the first filter 510 removes the large-sized foreign matters from the air supplied to the inside of the cabinet through the inlet 131, and the second filter 520 removes the minute foreign matters and smell particles of the air supplied to the inside of the cabinet 100. Accordingly, the cleaned air is provided to the indoor room, whereby it is possible to maintain the optimum state of the indoor room.

As mentioned above, the air conditioner according to the present invention cools or heats the indoor room. In this case, it is required to provide the various components for changing the flow passage of the refrigerant according to the operation mode, whereby the system of the air conditioner is complicated, and the manufacturing cost increases. Accordingly, with demands for an air conditioner obtaining simplified structure and low manufacturing cost, an air conditioner having an improved structure according to the fourth embodiment of the present invention is provided. The air conditioner according to the present invention according to the fourth embodiment of the present invention includes the simplified structure for cooling the indoor room with the refrigerant, and also includes a supplementary heating device for heating the indoor room with another means instead of the refrigerant. Hereinafter, the aforementioned air conditioner according to the fourth embodiment of the present invention will be described with reference to FIG. 11 to FIG. 14.

Figure 11:
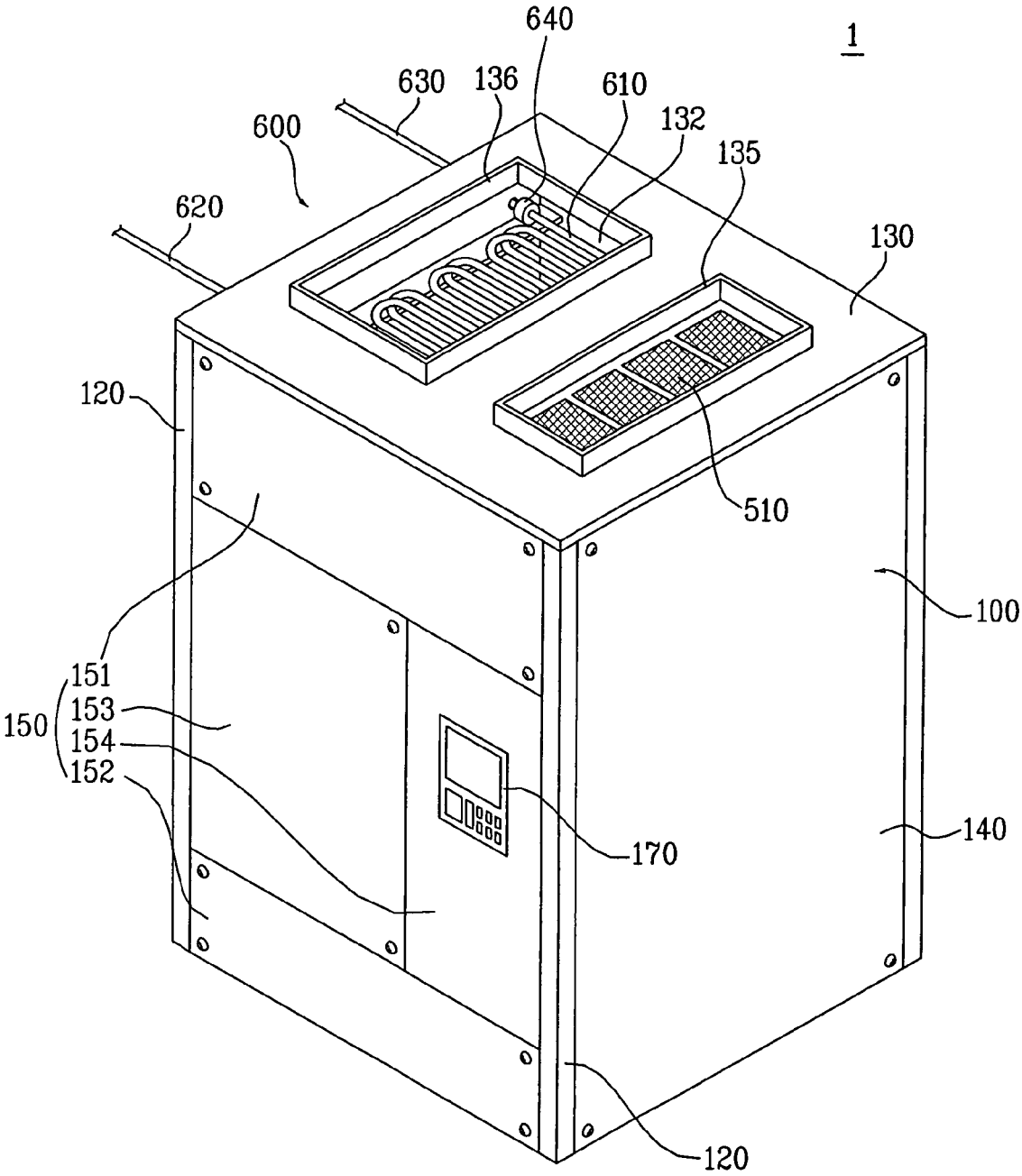
FIG. 11 is a perspective view illustrating an air conditioner according to the fourth embodiment of the present invention.
Figure 12:
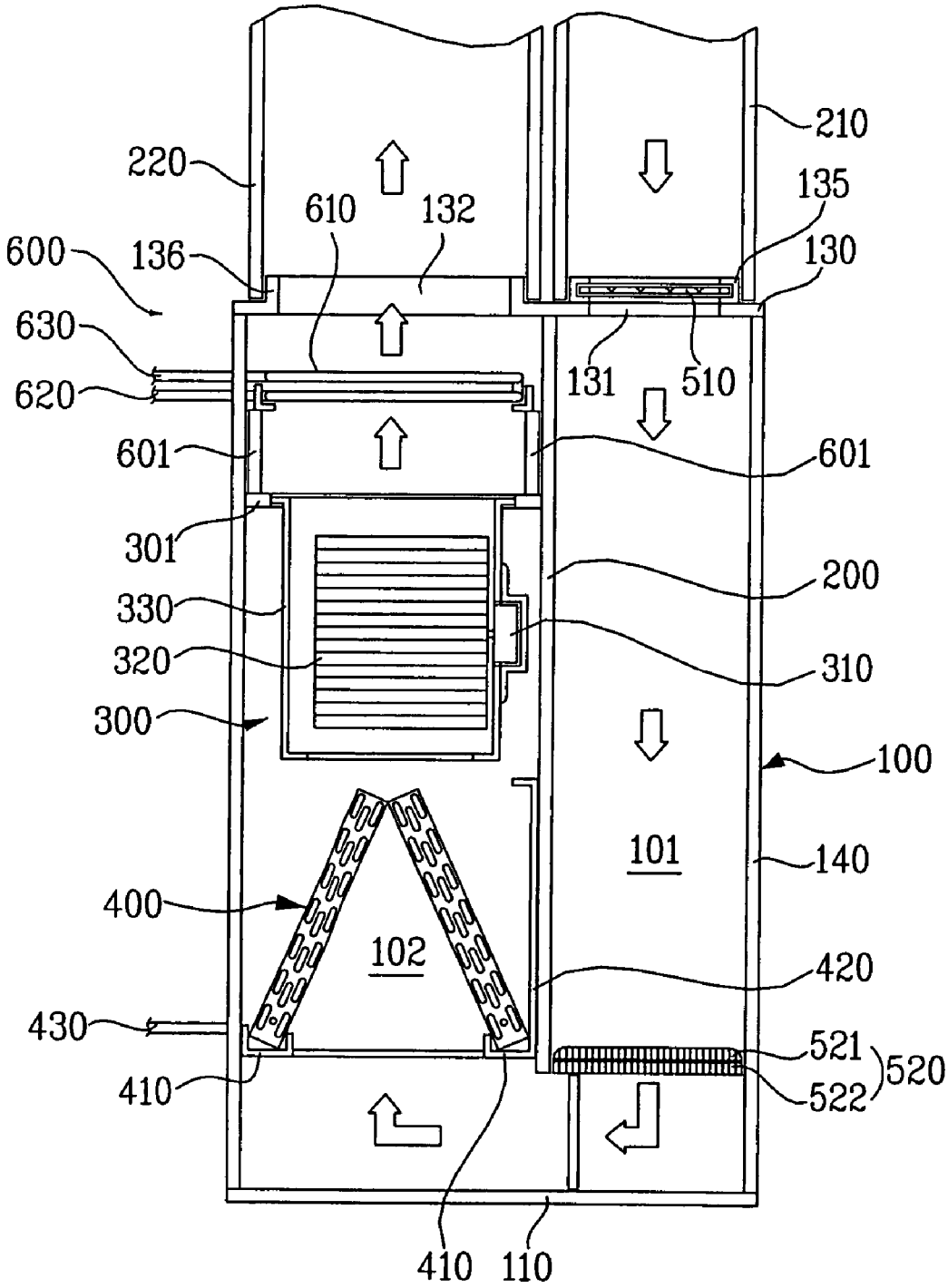
FIG. 12 is a cross-sectional view illustrating the inside of the air conditioner of FIG. 11.

Referring to FIG. 11 and FIG. 12, the supplementary heating device 600 is provided in a cabinet 100, for example, between a blower 300 and an outlet 132. The supplementary heating device 600 heats the air by the heat-exchange of the air discharged through the outlet 132 by the blower 300. Accordingly, the air heated by the supplementary heating device 600 is supplied to the indoor room through a first duct 210, thereby heating the indoor room.

The supplementary heating device 600 provides the air heated by another means instead of the refrigerant. For example, the supplementary heating device 600 heats the air with hot water. Thus, the supplementary heating device 600 is comprised of a first pipe 610 through which the hot water flows. In this case, as shown in FIG. 14, it is preferable to connect the first pipe 610 with a second pipe 720 being laid under the floor of the room to heat the room. Hereinafter, this structure will be described in more detail.

As shown in FIG. 12, the first pipe 610 is supported with a supporter 601 provided on an upper part of a bracket 301 supporting the blower 300. Then, both ends of the first pipe 610 are respectively connected with a first tube 620 and a second tube 630 by joints 640, the first and second tubes 620 and 630 penetrating the cabinet 100. In this case, the first and second tubes 620 and 630 are connected with the second pipe 720 being laid under the floor of the room.

In the aforementioned structure, after operating a boiler 710, the hot water flows through the second pipe 720, and then flows into the first pipe 610 through the first tube 620. Accordingly, the hot water flowing to the first pipe 610 heats the air flowing through the second flow passage 102. Then, the hot water completing the heat-exchange with the air moves to the second pipe 720 through the second tube 630.

Thus, the air conditioner according to the fourth embodiment of the present invention may be applied to the heating system previously mounted in the building for heating the room, thereby obtaining the effective heating system at a low cost.

Figure 13:
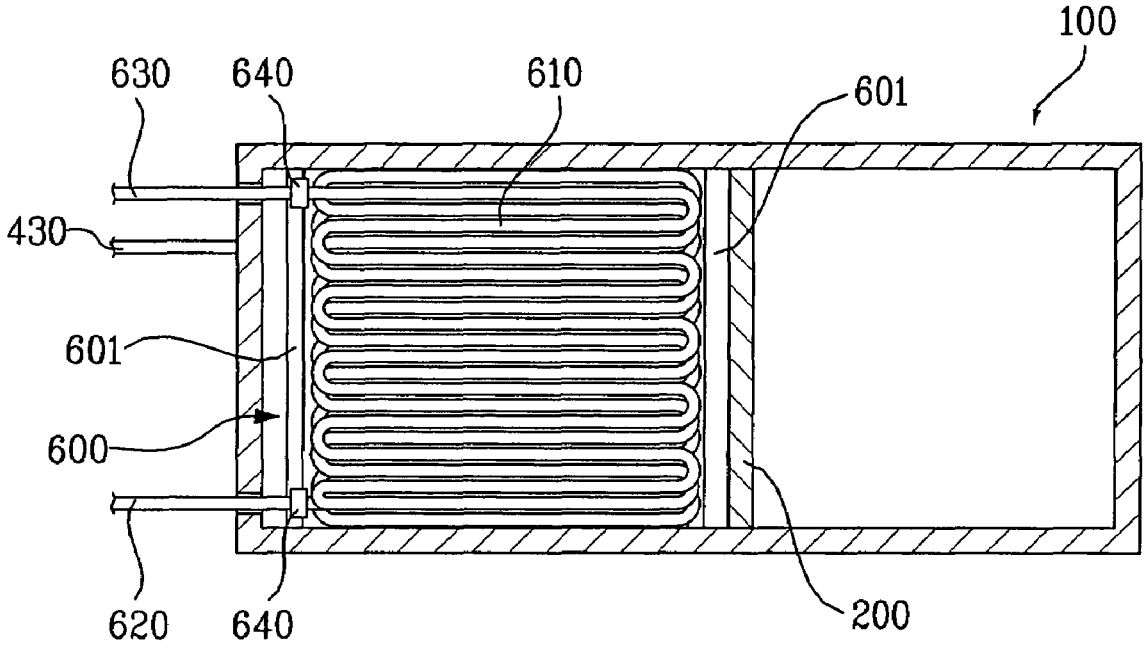
FIG. 13 is a cross-sectional view illustrating a supplementary heating device mounted on the air conditioner of FIG. 11.

Preferably, the first pipe 610 is formed in a shape having curved portions at several times so as to increase a heat-exchange area of the air flowing along the second flow passage 102. For example, as shown in FIG. 12, the first pipe 610 may be formed in two layers, and the first pipe 610 may be curved at several times as shown in FIG. 13. In this case, the first layer of the first pipe 610 is not corresponding to the second layer of the first pipe 610. In this structure, it is possible to increase the heat-exchange area with the air, thereby improving efficiency of the heat-exchange and heating process.

In addition, a valve (not shown) for controlling the flow passage of the hot water may be provided in the first unit 1 having the supplementary heating device 600. The valve may be hand-operated, or operated automatically. Also, the valve may be provided in the first tube 620, the second tube 630 or the first pipe 610. Furthermore, a bypass may be provided so as to prevent the water of the second pipe 720 from flowing into the first and second tubes 620 and 630. In this structure, when the air conditioner is not operated, the water does not flow into the first pipe 610.

Meanwhile, the air conditioner having the supplementary heating device 600 according to the fourth embodiment of the present invention may be formed of the structure having the valves and bypass to change the flow passage of the refrigerant according to the operation mode. In this case, the air conditioner selectively cools or heats the indoor room. Accordingly, when the air conditioner heats the indoor room, if the hot water is provided to the supplementary heating device 600, the heating efficiency of the air conditioner is improved.

As mentioned above, the air conditioner according to the preferred embodiments of the present-invention has the following advantages.

First, the inlet and the outlet are provided in the top of the cabinet, whereby it is easy to connect the inlet with the outlet by the duct being in communication with the inside. Accordingly, it is possible to easily mount the air conditioner according to the circumstances of the building.

Also, the slot is provided in the extension projected from the circumference of the inlet, whereby the filter is inserted thereto. Accordingly, the user can easily clean or change the filter.

Furthermore, the front panel of the cabinet is provided with the plurality of pieces being separated from one another. Accordingly, the components provided in the cabinet may be repaired or changed with easiness.

Also, the first unit for supplying the heated or cooled air to the indoor room is provided with the two filters having the different functions. Thus, the first unit supplies the cleaned air to the indoor room, whereby it is possible to maintain the optimum state of the air inside the room.

In case the supplementary heating device is provided in the first unit, it is possible to connect the supplementary heating device with the device for heating the inside. Accordingly, the effective heating system is obtained at a low cost, thereby improving the heating efficiency of the air conditioner.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An air conditioner comprising:

a cabinet having an inlet for supplying air of an indoor room to the inside thereof, and an outlet for discharging the air conditioned therein to the indoor room;

a barrier provided in the inside of the cabinet so as to guide the air supplied through the inlet to the outlet;

a blower provided in the inside of the cabinet to draw the air of the indoor room through the inlet and to discharge the air to the outlet; and a heat exchanger provided in the inside of the cabinet to perform a heat-exchange process with the air flowing in the cabinet, wherein the cabinet further includes a first extension projecting from the periphery of the inlet, the first extension having a slot for supporting the periphery of a first filter provided for covering the inlet and which is insertable through an open side of the first extension.

2. The air conditioner as claimed in claim 1, wherein the cabinet further includes:

a plurality of frames being standing at corners of a base;

an upper panel provided on upper parts of the frames, the upper panel having the inlet and the outlet; and a plurality of panels including a front panel, a rear panel and side panels between the respective frames.

3. The air conditioner as claimed in claim 1, wherein the front panel of the cabinet is provided with a plurality of pieces for being separately detachable.

4. The air conditioner as claimed in claim 1, wherein the barrier is provided between the inlet and the outlet.

5. The air conditioner as claimed in claim 1, wherein the cabinet includes a second extension projecting from the periphery of the outlet of the cabinet.

6. The air conditioner as claimed in claim 1, further comprising a first duct having one end connected with the first extension, and the other end being in communication with at least one room or the outside.

7. The air conditioner as claimed in claim 1, wherein the slot is provided along the inner surface of the first extension.

8. The air conditioner as claimed in claim 1, wherein the slot is provided between the top of the cabinet and an upper part of the first extension.

9. The air conditioner as claimed in claim 1, further comprising a second filter provided in the inside of the cabinet so as to filter foreign matters and small particles of the air supplied to the inside of the cabinet through the inlet.

10. The air conditioner as claimed in claim 1, further comprising a supplementary heating device provided in the cabinet for heat-exchange with the air flowing in the cabinet.

11. The air conditioner as claimed in claim 10, wherein the supplementary heating device is a first pipe through which hot water flows.

12. The air conditioner as claimed in claim 1, wherein the inlet and the outlet are provided on a top surface of the cabinet.

13. The air conditioner as claimed in claim 1, wherein the inlet and the outlet are provided on a same surface of the cabinet, and wherein the surface is located on a longitudinal end of the cabinet.

14. The air conditioner as claimed in claim 1, wherein the barrier comprises:

a first end connected with the cabinet between the inlet and the outlet; and a second end positioned in the cabinet with a predetermined interval from a surface of the cabinet opposite to a surface of the cabinet to which the first end is connected.

15. The air conditioner as claimed in claim 10, wherein the supplementary heating device is configured to be connected with a boiler to heat the indoor room.

16. An air conditioner comprising:

a cabinet having an inlet for supplying air of an indoor room to the inside thereof, and an outlet for discharging the air conditioned therein to the indoor room;

a barrier provided in the inside of the cabinet so as to guide the air supplied through the inlet to the outlet;

a blower provided in the inside of the cabinet to draw the air of the indoor room through the inlet and to discharge the air to the outlet;

a heat exchanger provided in the inside of the cabinet to perform a heat-exchange process with the air flowing in the cabinet; and a supplementary heating device provided in the cabinet for heat-exchange with the air flowing in the cabinet, wherein the supplementary heating device is a first pipe through which hot water flows, and wherein the first pipe is configured to be connected to a second pipe being laid under a floor of the indoor room to heat the room.

17. An air conditioner comprising:

a cabinet including a top surface, the top surface having an inlet connectable with a duct for introducing air into the cabinet, and an outlet connectable with a duct for discharging air from the cabinet;

a blower provided in the cabinet to draw the air of the indoor room through the inlet and to discharge the air to the outlet; and a heat exchanger provided in the inside of the cabinet to perform a heat-exchange process with the air flowing in the cabinet, wherein the cabinet further includes a first extension projecting from the periphery of the inlet, the first extension having a slot for supporting the periphery of a first filter provided for covering the inlet and which is insertable through an open side of the first extension.

18. An air conditioner comprising:

a cabinet including a top surface having both an inlet connectable with a duct for introducing air into the cabinet, and an outlet connectable with a duct for discharging air from the cabinet;

a blower provided in the cabinet to draw air through the inlet and to discharge the air to the outlet;

a heat exchanger provided in the inside of the cabinet to perform a heat-exchange process with the air flowing in the cabinet;

a barrier provided on the inside of the cabinet and between the inlet and the outlet to draw the air through the inlet to the outlet and to form a U-shaped air passage within the cabinet in which the air is drawn through the inlet, passes through the U-shaped air passage, and is discharged through the outlet on the top surface of the cabinet; and a first filter provided for covering the inlet, wherein the cabinet includes a first extension projecting from the periphery of the inlet, and having a slot supporting the periphery of the first filter which is inserted or separated through an open side of the first extension.

19. An air conditioner comprising:

a cabinet including a top surface having both an inlet connectable with a duct for introducing air into the cabinet, and an outlet connectable with a duct for discharging air from the cabinet;

a blower provided in the cabinet to draw air through the inlet and to discharge the air to the outlet;

a heat exchanger provided in the inside of the cabinet to perform a heat-exchange process with the air flowing in the cabinet;

a barrier provided on the inside of the cabinet and between the inlet and the outlet to draw the air through the inlet to the outlet and to form a U-shaped air passage within the cabinet in which the air is drawn through the inlet, passes through the U-shaped air passage, and is discharged through the outlet on the top surface of the cabinet; and a supplementary heating device provided in the cabinet for heat-exchange with the air flowing in the cabinet, wherein the supplementary heating device is configured to be connected with a pipe being laid under a floor of the indoor room to heat the room.

* * * * *